US005467980A

United States Patent [19]

Weisenstein

[11] Patent Number: 5,467,980

[45] Date of Patent: Nov. 21, 1995

[54] GOLF CLUB SUPPORTING DEVICE

[76] Inventor: Larry Weisenstein, 16 Spyglass Hill Ct., Holmdel, N.J. 07733

[21] Appl. No.: 329,284

[22] Filed: Oct. 26, 1994

[51] Int. Cl.[6] ..... A63B 57/00

[52] U.S. Cl. ..... 273/32 B

[58] Field of Search ..... 273/32 R, 32 B, 273/32 E

[56] References Cited

U.S. PATENT DOCUMENTS

| | | | |
|---|---|---|---|
| D. 318,090 | 7/1991 | Bahns | D21/223 |
| D. 335,695 | 5/1993 | Beck | D21/223 |
| 4,832,338 | 5/1989 | Magazzi | 273/32 E X |
| 4,991,839 | 2/1991 | Lumbattis, Jr. | 273/32 R |
| 5,076,581 | 12/1991 | Boberg | 273/32 R |
| 5,080,239 | 1/1992 | Rowland | 273/32 E X |
| 5,116,046 | 5/1992 | Pace | 273/32 B |
| 5,127,530 | 7/1992 | Ortuno | 273/32 E X |
| 5,149,087 | 9/1992 | Thompson, Jr. | 273/32 B |
| 5,285,990 | 2/1994 | Engel | 273/32 B X |
| 5,286,019 | 2/1994 | Watabe | 273/32 B |

*Primary Examiner*—William H. Grieb

[57] ABSTRACT

A device for supporting a least a portion of a golf club relative to a ground surface. The inventive device includes a ground engaging assembly for piercing and engaging a ground surface. A handle engaging assembly is coupled to an upper end of the ground engaging assembly for receiving a handle of a golf club to support the golf club in a leaning or suspended position relative to the ground surface.

6 Claims, 4 Drawing Sheets

GOLF CLUB SUPPORTING DEVICE

BACKGROUND OF THE INVENTION

1. Field of the Invention

The present invention relates to support structures and more particularly pertains to a golf club supporting device for supporting at least a portion of a golf club relative to a ground surface.

2. Description of the Prior Art

The use of support structures is known in the prior art. More specifically, support structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art support structures include U.S. Pat. Nos. 4,991,839; 5,076,581; 5,080,239; 5,286,046; 5,285,990; 5,286,019; U.S. Pat. Nos. Des. 318,090 and Des. 335,695.

While these devices fulfill their respective, particular objectives and requirements, the aforementioned patents do not disclose a golf club supporting device for supporting at least a portion of a golf club relative to a ground which includes a ground engaging means for piercing and engaging a ground surface, and a handle engaging means coupled to an upper end of the ground engaging means for receiving a handle of a golf club to support the golf in a leaning or suspended orientation relative to the ground surface.

In these respects, the golf club supporting device according to the present invention substantially departs from the conventional concepts and designs of the prior art, and in so doing provides an apparatus primarily developed for the purpose of supporting a portion of a golf club relative to a ground surface.

SUMMARY OF THE INVENTION

In view of the foregoing disadvantages inherent in the known types of support structures now present in the prior art, the present invention provides a new golf club supporting device construction wherein the same can be utilized for supporting at least a portion of a golf club relative to a ground surface. As such, the general purpose of the present invention, which will be described subsequently in greater detail, is to provide a new golf club supporting device apparatus and method which has many of the advantages of the support structures mentioned heretofore and many novel features that result in a golf club supporting device which is not anticipated, rendered obvious, suggested, or even implied by any of the prior art support structures, either alone or in any combination thereof.

To attain this, the present invention generally comprises a device for supporting a least a portion of a golf club relative to a ground surface. The inventive device includes a ground engaging assembly for piercing and engaging a ground surface. A handle engaging assembly is coupled to an upper end of the ground engaging assembly for receiving a handle of a golf club to support the golf club in a leaning or suspended position relative to the ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf club supporting device apparatus and method which has many of the advantages of the support structures mentioned heretofore and many novel features that result in a golf club supporting device which is not anticipated, rendered obvious, suggested, or even implied by any of the prior art support structures, either alone or in any combination thereof.

It is another object of the present invention to provide a new golf club supporting device which may be easily and efficiently manufactured and marketed.

It is a further object of the present invention to provide a new golf club supporting device which is of a durable and reliable construction.

An even further object of the present invention is to provide a new golf club supporting device which is susceptible of a low cost of manufacture with regard to both materials and labor, and which accordingly is then susceptible of low prices of sale to the consuming public, thereby making such golf club supporting devices economically available to the buying public.

Still yet another object of the present invention is to provide a new golf club supporting device which provides in the apparatuses and methods of the prior art some of the advantages thereof, while simultaneously overcoming some of the disadvantages normally associated therewith.

Still another object of the present invention is to provide a new golf club supporting device for supporting at least a portion of a golf club relative to a ground surface.

Yet another object of the present invention is to provide a new golf club supporting device which includes a ground engaging means for piercing and engaging a ground surface, and a handle engaging means coupled to an upper end of the ground engaging means for receiving a handle of a golf club to support the golf in a leaning or suspended orientation relative to the ground surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
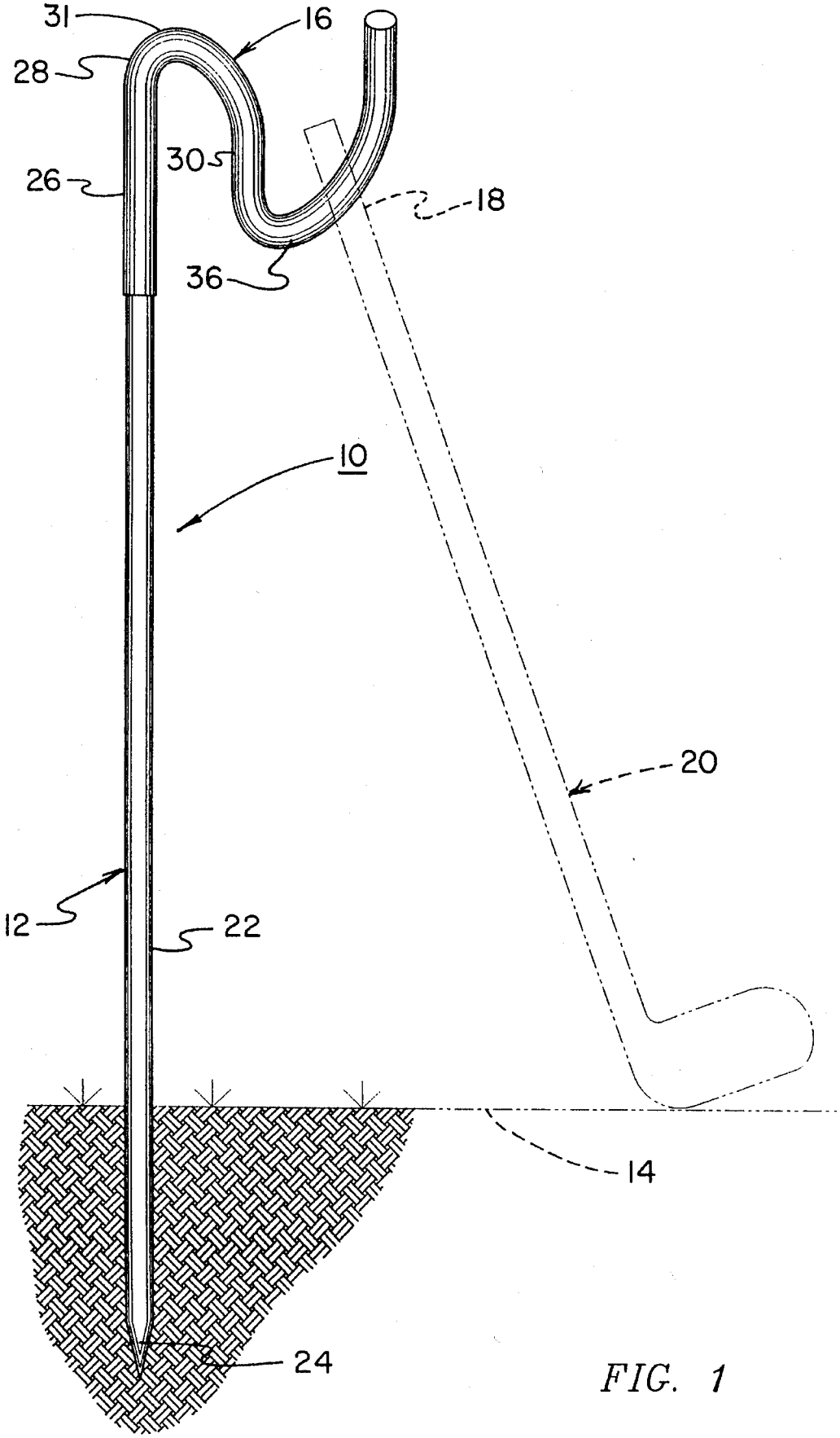
FIG. 1 is an isometric illustration of a golf club supporting device according to the present invention in use.

With reference now to the drawings, and in particular to FIGS. 1–7 thereof, a new golf club supporting device embodying the principles and concepts of the present invention and generally designated by the reference numeral 10 will be described.

Figure 6:
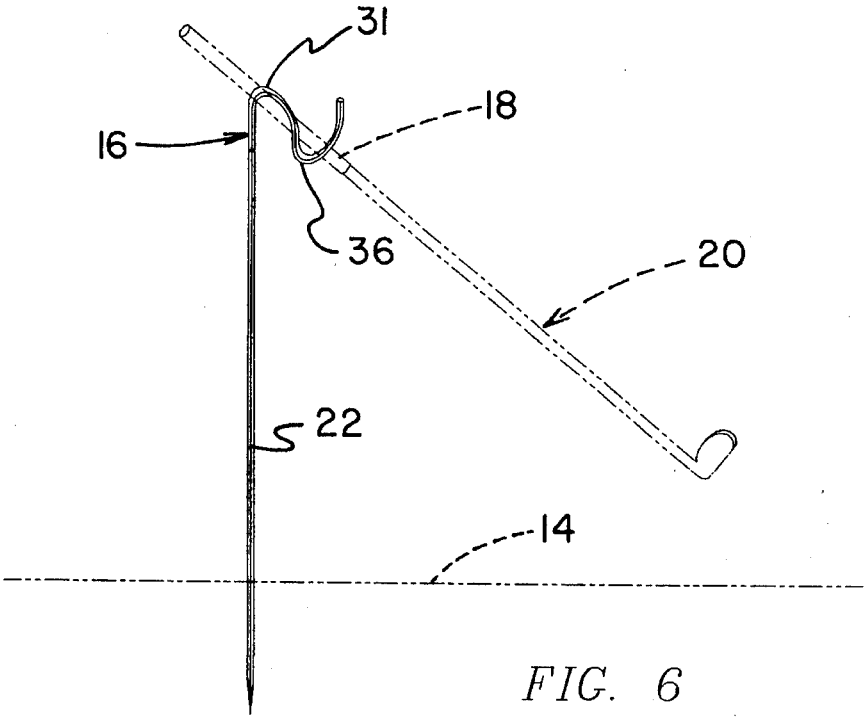
FIG. 6 is a front elevation view of the present invention illustrating an alternative use thereof.

More specifically, it will be noted that the golf club supporting device 10 comprises a ground engaging means 12 for piercing and engaging a ground surface 14, and a handle engaging means 16 coupled to an upper distal end of the ground engaging means 12 for engaging a handle 18 of a golf club 20 to support the golf club in the leaning position illustrated in FIG. 1, or alternatively, in the suspended orientation illustrated in FIG. 6 of the drawings.

Figure 2:
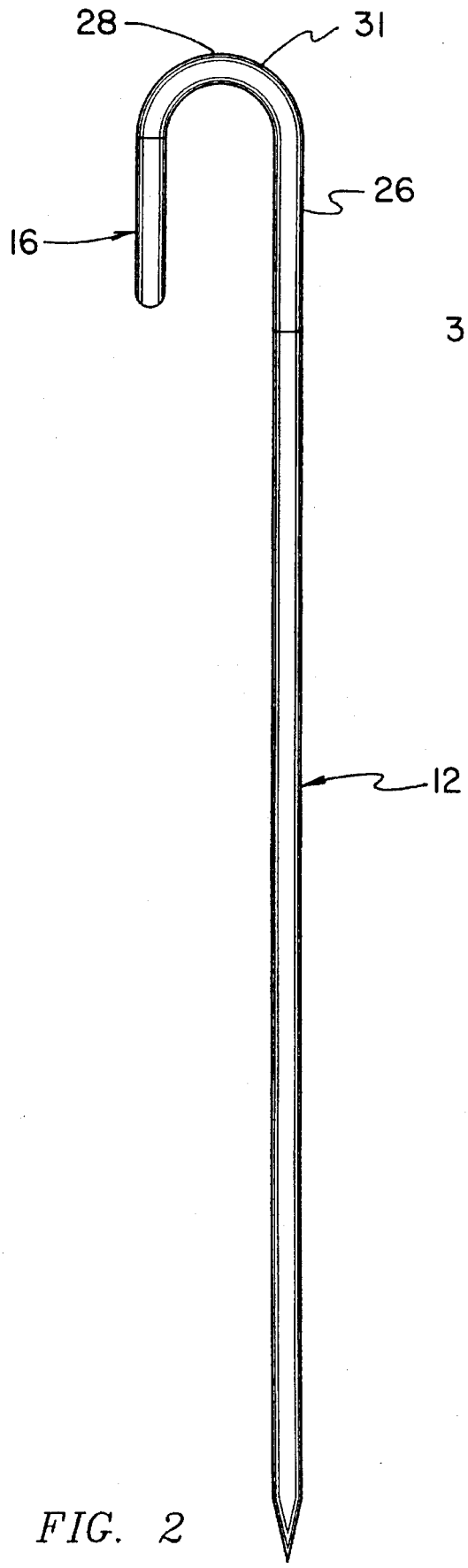
FIG. 2 is a rear elevation view thereof.
Figure 3:
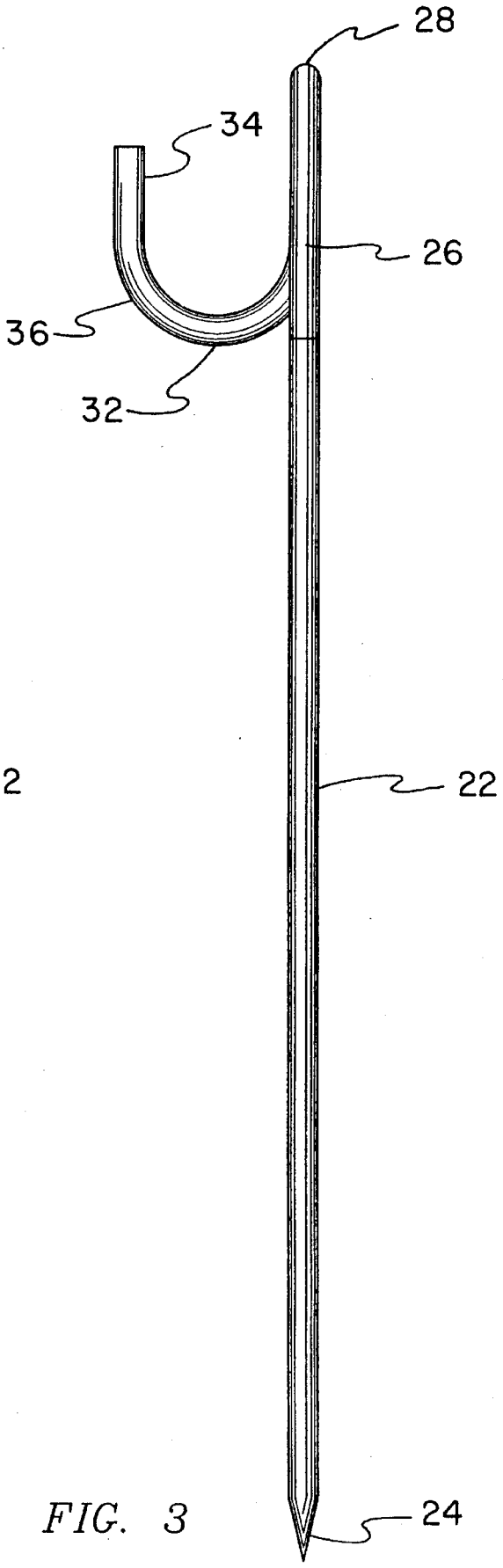
FIG. 3 is a side elevation view of the present invention.
Figure 4:
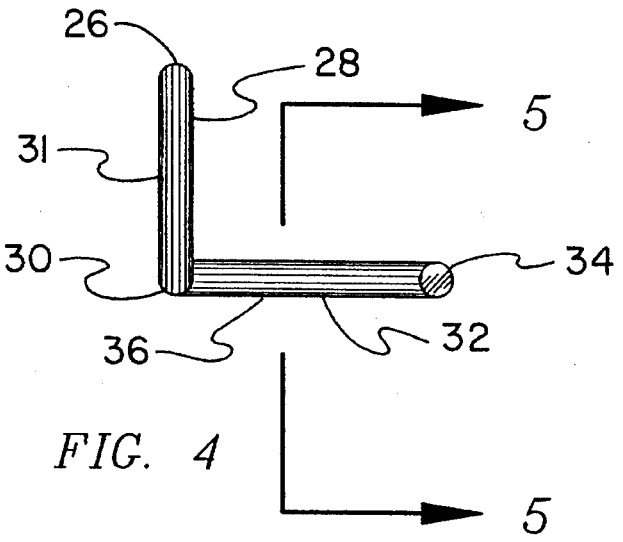
FIG. 4 is a top plan view of the invention.

As best illustrated in FIGS. 1 through 3, it can be shown that the ground engaging means 12 according to the present invention 10 preferably comprises a substantially circular cross section elongated stake 22 having an upper distal end to which the handle engaging means 16 is attached, with the elongated stake being shaped so as to define a piercing tip 24 at a lower end thereof operable to pierce the ground surface 14 during an insertion of the elongated stake 22 thereinto. By this structure, the elongated stake 22 of the ground engaging means 12 can be forced into the ground surface 14, whereby the circular cross section of the elongated stake permits rotation of the ground engaging means 12 relative to the ground surface as desired to orient the handle engaging means 16 into an desired orientation.

Figure 5:
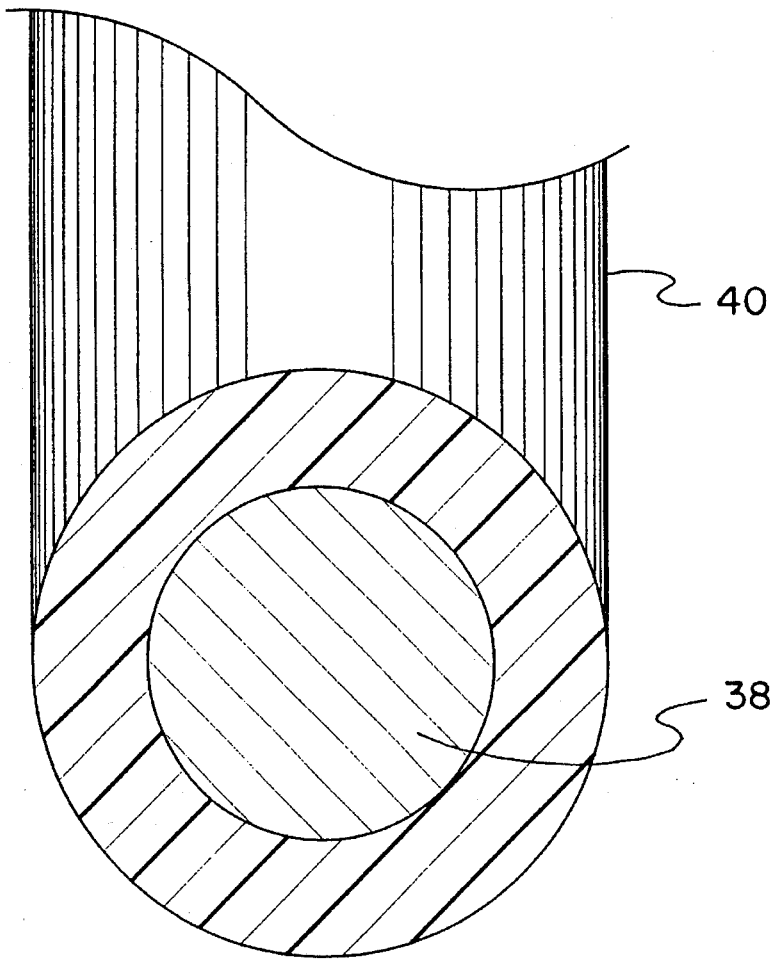
FIG. 5 is a cross sectional view taken along line 5—5 of FIG. 4.

As best illustrated in FIGS. 1 through 4, it can be shown that the handle engaging means 16 according to the present invention 10 preferably comprises an upper portion 26 of the elongated stake 22 shaped so as to define a first integral bend 28 continuing into a connecting portion 30 extending into a substantially spaced and parallel orientation relative to the upper portion 26 so as to define a first U-hook 31. The handle engaging means 16 further comprises a second integral bend 32 continuing from the connecting portion 30 and extending into a terminating portion 34 positioned in a substantially spaced and parallel orientation relative to the connecting portion 30 to define a second U-hook 36. Preferably, the first U-hook 31 resides within a first plane, and the second U-hook 36 resides within a second plane, wherein the second plane is oriented perpendicularly relative to the first plane. Preferably, and as illustrated in FIG. 5, the elongated stake 22 is comprised of a single wire member 38 which integrally continues into the handle engaging means 16 as described above, with the handle engaging means 16 further comprising a resilient coating 40 extending circumferentially about the single wire member 38 to protect the handle 18 of the golf club 20 against abrasion and further to enhance frictionally engagement between the handle engaging means 16 and the handle.

Figure 7:
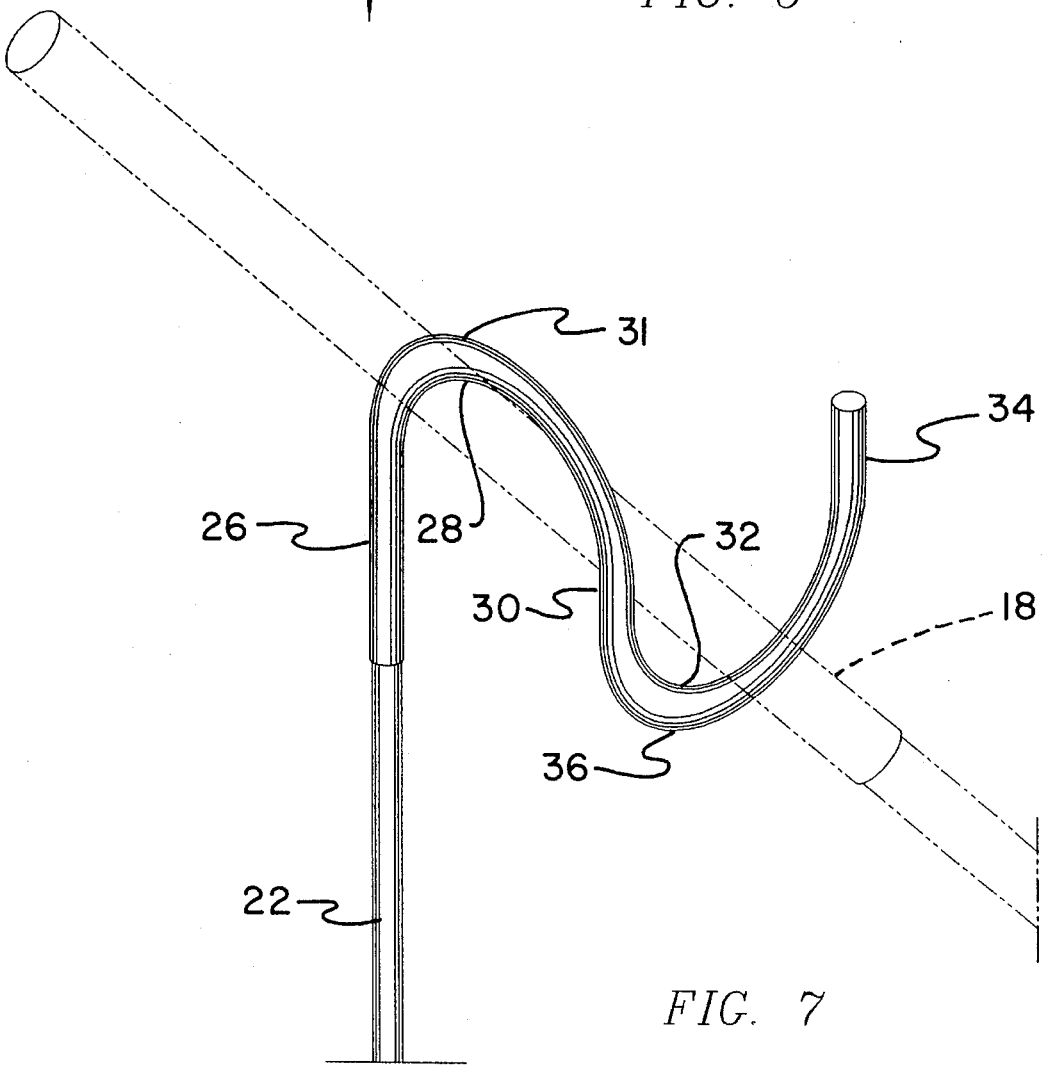
FIG. 7 is a enlarged front elevation view of a portion of the present invention illustrated in FIG. 6.

As illustrated in FIG. 1, the present invention 10 can be utilized to support the handle 18 of a golf club 20 in a leaning position relative to the ground surface 14. Referring now To FIGS. 6 and 7, it can be shown that the handle 18 of the golf club 20 can be engaged to the first and second U-hooks 31, 36 to support the golf club 20 in a suspended position relative to the ground surface 14. In this orientation, the handle 18 engages an interior surface of the first integral bend 28 of the first U-hook 31 and extends between the upper portion 26 and the connecting portion 30 of the first U-hook. Similarly, the handle 18 engages an interior surface of the second integral bend 32 of the second U-hook 36 so as to extend between the connecting portion 30 and the terminating portion 34 of the second U-hook. In this configuration, diametrically opposed surfaces of the handle 18 are supported to position the golf club 20 in the cantilevered orientation illustrated in FIG. 6. By the structure and methods disclosed herein, a golf club 20 can be supported relative to a ground surface to preclude the handle 18 from engaging the ground surface, thereby maintaining the handle in a dry condition. Further, the present invention serves to preclude lost clubs 20 which may have been laid down in thick grass or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf club supporting device comprising, in combination:

a substantially circular cross section elongated stake having an upper distal end and a lower end being shaped so as to define a piercing tip forming a ground engaging means, the ground engaging means being capable of piercing and engaging a ground surface during an insertion of the elongated stake thereinto; and a handle engaging means coupled to the upper distal end of the elongated stake for engaging a handle of a golf club to support the golf club relative to the ground surface, the handle engaging means capable of various orientations when the circular cross section of the elongated stake permits rotation of the ground engaging means relative to the ground surface, the handle engaging means including an upper portion of the elongated stake shaped so as to define a first integral bend continuing into a connection portion extending into a substantially spaced and parallel orientation relative to the upper portion so as to define a first U-hook, the handle engaging means further comprising a second integral bend continuing from the connecting portion and extending into a terminating portion positioned in a substantially spaced and parallel orientation relative to the connecting portion to define a second U-hook, the first U-hook residing within a first plane, and the second U-hook residing within, a second plane, wherein the second plane is oriented perpendicularly relative to the first plane.

2. The golf club supporting device of claim 1, wherein the elongated stake is comprised of a single wire member which integrally continues into the handle engaging means.

3. The golf club supporting device of claim 2, wherein the handle engaging means further comprises a resilient coating extending circumferentially about the single wire member to protect the handle of the golf club against abrasion and further to enhance frictionally engagement between the handle engaging means and the handle.

4. A method of supporting a golf club, the method comprising:

providing a golf club supporting device comprising a ground engaging means for piercing and engaging a ground surface, the ground engaging means comprising a substantially circular cross section elongated stake having an upper distal end to which the handle engaging means is attached, the elongated stake being shaped so as to define a piercing tip at a lower end thereof operable to pierce the ground surface during an insertion of the elongated stake thereinto, wherein the circular cross section of the elongated stake permits rotation of the ground engaging means relative to the ground surface to orient the handle engaging means into an desired orientation; and, a handle engaging means coupled to an upper distal end of the ground engaging means for engaging a handle of a golf club to support the golf club relative to a ground surface, the handle engaging means comprising an upper portion of the elongated stake shaped so as to define a first integral bend continuing into a connecting portion extending into a substantially spaced and parallel orientation relative to the upper portion so as to define a first U-hook, the handle engaging means further comprising a second integral bend continuing from the connecting portion and extending into a terminating portion positioned in a substantially spaced and parallel orientation relative to the connecting portion to define a second U-hook, the first U-hook residing within a first plane, and the second U-hook residing within a second plane, wherein the second plane is oriented perpendicularly relative to the first plane;

inserting said stake member into a ground surface;

providing a golf club having a head and a handle;

positioning said golf club head onto said ground surface; and, leaning said golf club handle against said handle engaging means so as to place said handle into said second U-hook.

5. A method of supporting a golf club, the method comprising:

(a) providing a golf club supporting device comprising a ground engaging means for piercing and engaging a ground surface, the ground engaging means comprising a substantially circular cross section elongated stake having an upper distal end to which the handle engaging means is attached, the elongated stake being shaped so as to define a piercing tip at a lower end thereof operable to pierce the ground surface during an insertion of the elongated stake thereinto, wherein the circular cross section of the elongated stake permits rotation of the ground engaging means relative to the ground surface to orient the handle engaging means into an desired orientation; and, a handle engaging means coupled to an upper distal end of the ground engaging means for engaging a handle of a golf club to support the golf club relative to a ground surface, the handle engaging means comprising an upper portion of the elongated stake shaped so as to define a first integral bend continuing into a connecting portion extending into a substantially spaced and parallel orientation relative to the upper portion so as to define a first U-hook, the handle engaging means further comprising a second integral bend continuing from the connecting portion and extending into a terminating portion positioned in a substantially spaced and parallel orientation relative to the connecting portion to define a second U-hook, the first U-hook residing within a first plane, and the second U-hook residing within a second plane, wherein the second plane is oriented perpendicularly relative to the first plane;

(b) inserting said stake member into a ground surface;

(c) providing a golf club having a head and a handle;

(d) positioning said golf club head onto said ground surface;

and, (e) positioning the handle of the golf club relative to the first and second U-hooks to support the golf club in a suspended position relative to the ground surface.

6. The method of supporting a golf club of claim 5, wherein step (e) further comprises positioning a first portion of the handle of the golf club into engaging contact with an interior surface of the first integral bend of the first U-hook such that the first portion of the handle extends between the upper portion and the connecting portion of the first U-hook; and positioning a second portion of the handle into engaging contact with an interior surface of the second integral bend of the second U-hook such that the second portion of the handle extends between the connecting portion and the terminating portion of the second U-hook, whereby diametrically opposed surfaces of the handle are supported relative to the handle engaging means to position the golf club in a cantilevered orientation.

* * * * *